US005857229A

United States Patent [19]

Magnani, Jr.

[11] Patent Number: 5,857,229

[45] Date of Patent: Jan. 12, 1999

[54] PLAYYARD HINGE

[76] Inventor: Tom J. Magnani, Jr., 1503 Paradise Trail, Troy, Ohio 45373

[21] Appl. No.: 927,618

[22] Filed: Sep. 11, 1997

[51] Int. Cl.[6] ..... A47D 13/06; E05D 11/10; E16C 11/10

[52] U.S. Cl. ..... 5/99.1; 5/98.1; 16/323; 16/325; 403/102

[58] Field of Search ..... 5/98.1, 99.1; 16/323, 16/325; 403/102, 325

[56] References Cited

U.S. PATENT DOCUMENTS

| | | | |
|---|---|---|---|
| 5,293,656 | 3/1994 | Chan | 5/99.1 |
| 5,353,451 | 10/1994 | Hsiung | 5/99.1 |
| 5,483,710 | 1/1996 | Chan | 5/99.1 |
| 5,745,954 | 5/1998 | Shogan et al. | 5/99.1 X |
| 5,761,755 | 6/1998 | Huang | 5/99.1 |

*Primary Examiner*—Kenneth J. Dorner
*Assistant Examiner*—Robert Santos

[57] ABSTRACT

A hinge positioned at the intermediate extents of the adjacent rail components to hold such components in an aligned orientation including a saddle with a central button aperture, interior plate apertures and exterior end apertures with associated rail pins for pivotally coupling the saddle and the adjacent interior ends of associated rail components, a pair of hinge plates each with a plate pin coupling the upper end of each plate to a plate aperture of the saddle, each plate having an opening extending therethrough, the plates urged away from each other, a liftable block with an elongated slot and with an associated block pin for slidably coupling the block to the saddle, the button having inclined bearing surfaces on their edges and an inwardly facing projection located at the adjacent interior edge of each adjacent rod segment, each projection having an upper curved surface and a lower planar surface receivable by the bearing opening.

3 Claims, 7 Drawing Sheets

PLAYYARD HINGE

BACKGROUND OF THE INVENTION

1. Field of the Invention

The present invention relates to a hinge and, more particularly, to a playyard having a hinge adapted to safely and conveniently convert the playyard between a deployed orientation and a collapsed orientation.

2. Description of the Prior Art

The use playyards for receiving and supporting children is well known. Further, playyards with foldable capabilities are also well known. Such foldable playyards typically have hinges for converting the playyard between an erect deployed orientation and a collapsed orientation for transportation and storage.

One key element to allow playyards to be retained in one orientation or another are hinges. Such hinges, however, must be made safe for the child and convenient for the health care provider. All known hinges suffer from one defect or the other.

The patent literature discloses various playyards with hinge capabilities. Note, for example, U.S. Pat. Nos. 5,293,656 and 5,483,710, both to Chan, as well as U.S. Pat. No. 4,811,437 to Dilner.

None of these playyards with their hinges, however, provides the safety and convenience attended with the present invention, the playyard with the new and improved hinge.

The present invention achieves its intended purposes, objects and advantages over the prior art through a new useful and unobvious combination of component elements, through the use of a minimum number of functioning parts, at a reasonable cost to manufacture, and through the utilization of only readily available and conventional materials.

Therefore, the present invention relates to a new and improved hinge positioned at the intermediate extents of the adjacent rail components to hold such components in an aligned orientation including a hinge for a collapsible playyard comprising a saddle in a generally inverted U-shaped configuration with opposed parallel faces and a coupling region thereabove, the opposed faces each having a pair of laterally spaced block apertures with block pins therebetween, a pair of laterally spaced rail apertures with rail pins therebetween, a pair of laterally spaced locking lever apertures with lever pins therethrough and a pair of laterally spaced generally horizontal guide slots with guide pins therethrough; a pair of normally vertically-oriented locking levers, each locking lever having a central aperture for receiving a lever pin, each locking lever having a lower end with a facing curved follower face and an upper end with an aperture receiving a lever pin and with an arcuate facing interior surface at the interior region thereof; a coil spring having a central horizontal axis with an exterior surface received within the facing recesses of the levers and with ends extending downwardly into contact with the exterior faces of the levers tending to move the lower ends of the levers inwardly and the upper ends of the levers outwardly; and a liftable block with generally vertically extending slots adjacent the lateral edges thereof receiving the block pins and adapted to allow the raising and lowering of the block between a lower locking deployed orientation and an upward unlocking collapsed orientation, the block also having a central region with cam surfaces adapted to contact the curved surfaces at the lower ends of the levers whereby movement of the block and the cam surfaces upwardly will urge the lower ends of the levers outwardly and the upper ends of the levers inwardly.

Therefore, it is an object of this invention to provide a playyard hinge which overcomes the aforementioned inadequacies of the prior art devices and which constitutes an improvement which is a significant contribution to the advancement of the art.

Another object of the invention is to provide for the convenient deployment and collapse of a playyard with maximum safety.

It is another object of the present invention to maximize the safety of a playyard hinge which may be easily and efficiently manufactured and marketed.

It is a further object of the present invention to provide a playyard hinge construction which is of a durable and reliable construction.

The foregoing has outlined some of the more pertinent objects of the present invention. These objects should be construed to be merely illustrative of some of the more prominent features and applications of the intended invention. Many other beneficial results could be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention as defined by the claims taken in conjunction with the accompanying drawings.

SUMMARY OF THE INVENTION

The invention is defined by the appended claims with the specific embodiment shown on the attached drawings. For the purposes of summarizing the invention, the invention essentially comprises a playyard hinge.

The present invention includes a playyard of the type having a frame with an upper rail assembly positionable in a horizontal orientation when in a deployed orientation and formed of two side rails and two end rails with each of the rails being formed of two rail components having interior ends and exterior ends, the interior ends being pivotally coupled with respect to each other for movement between the deployed orientation wherein the rails are horizontally disposed in a common plane and a collapsed orientation wherein the rails are vertically disposed and parallel, the frame also including a lower rail assembly positionable in a horizontal orientation beneath the upper rail assembly when in a deployed orientation, the frame also including four vertically extending corner rails coupling the upper rail assembly and the lower rail assembly, the playyard also having fabric components between the upper and lower frame assemblies and between the corner rails; a hinge positioned at the intermediate extents of the end rails and side rails to allow movement of the associated rail components between the horizontal deployed orientation and the collapsed orientation, each hinge including; a saddle in a generally inverted U-shaped configuration with opposed parallel faces and a coupling region thereabove, the opposed faces each having a pair of laterally spaced block apertures with block pins therebetween, a pair of laterally spaced rail apertures with rail pins therebetween, a pair of laterally spaced locking lever apertures with lever pins therethrough and a pair of laterally spaced generally horizontal guide slots with guide pins therethrough; a pair of normally vertically-oriented locking levers, each locking lever having a central aperture for receiving a lever pin, each locking lever having a lower end with a facing curved follower face and an upper end with an aperture receiving a lever pin and with an arcuate facing interior surface at the interior region thereof; a coil spring having a central horizontal axis with an exterior surface received within the facing recesses of the levers and with ends extending downwardly into contact with the exterior faces of the levers tending to move the lower ends of the levers inwardly and the upper ends of the levers outwardly; a liftable block with generally vertically extending slots adjacent the lateral edges thereof receiving the block pins and adapted to allow the raising and lowering of the block between a lower locking deployed orientation and an upward unlocking collapsed orientation, the block also having a central region with cam surfaces adapted to contact the curved surfaces at the lower ends of the levers whereby movement of the block and the cam surfaces upwardly will urge the lower ends of the levers outwardly and the upper ends of the levers inwardly; and facing projections located at the adjacent interior ends of each adjacent rod segment, each projection having an upper curved surface and a lower planar surface with an arcuate recess adapted to receive a guide pin when in the deployed locked orientation with the upper curved surfaces of the projections adapted to move the guide pins inwardly toward each other when moving the hinge from the stowed orientation to the locked orientation with the guide pin movement being guided by the guide slots whereby the positioning of the block in its lower orientation will allow the lower ends of the levers to be in proximity to each other and urged in such orientation by the coil spring but whereby upward movement of the hinge from the stowed orientation to the deployed orientation will move the guide pins and upper ends of the levers outwardly through the force of the upper curved surfaces of the projections to allow the positioning of the guide pins in the lower recesses of the projections and whereby, during collapsing, upward movement of the block will urge the lower ends of the levers outwardly and the inward ends of the levers inwardly to thereby separate the guide pins from the recesses of the projections and allow the projections and interior ends of the rails to move downwardly to collapse the hinge and frame of the playyard.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

The same reference numerals refer to the same parts throughout the various Figures.

DESCRIPTION OF THE PREFERRED EMBODIMENT

The present invention relates to a playyard with an improved hinge construction. In its broadest context, the present invention includes a frame structure to which fabric panels are secured. In addition, the upper rail assemblies each are composed of rail sections having interior ends safely but readily movable between a deployed and collapsed orientation.

Figure 1:
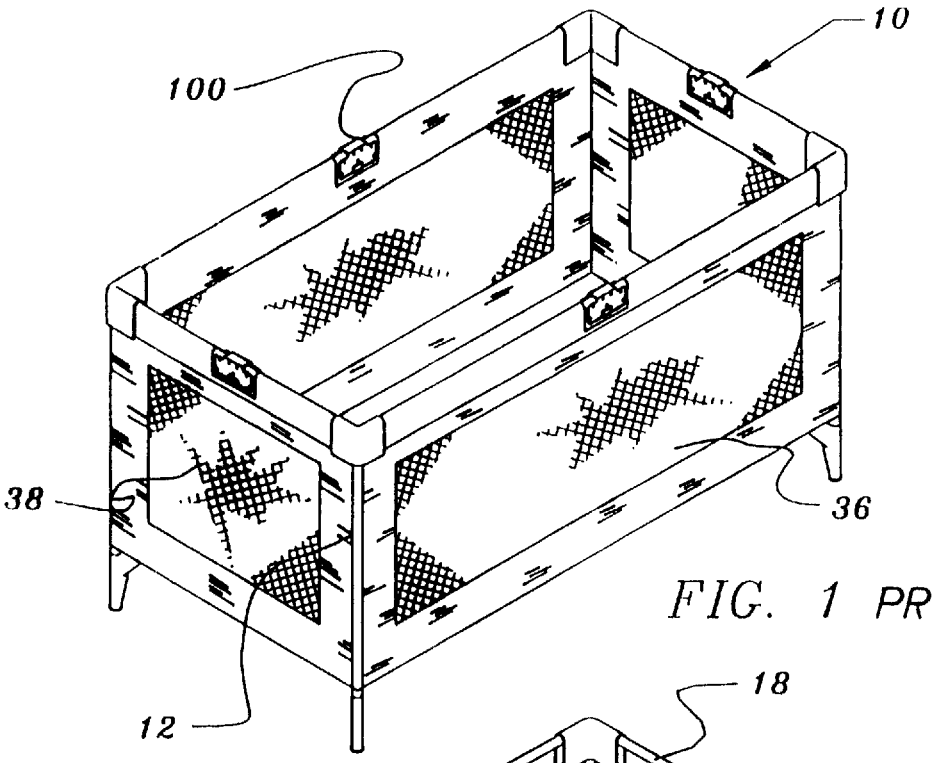
FIG. 1 PRIOR ART
FIG. 1 is a perspective illustration of a playyard constructed in accordance with the principles of the present invention.
Figure 2:
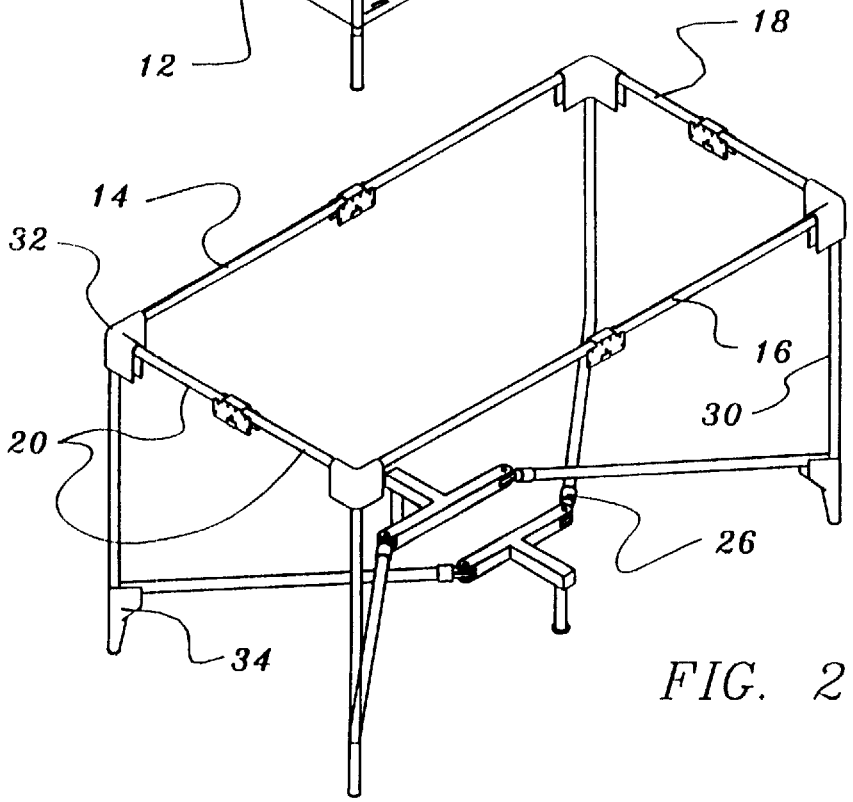
FIG. 2 PRIOR ART
FIG. 2 is a perspective showing similar to FIG. 1 but with the fabric enclosure removed to show the frame only.
Figure 3:
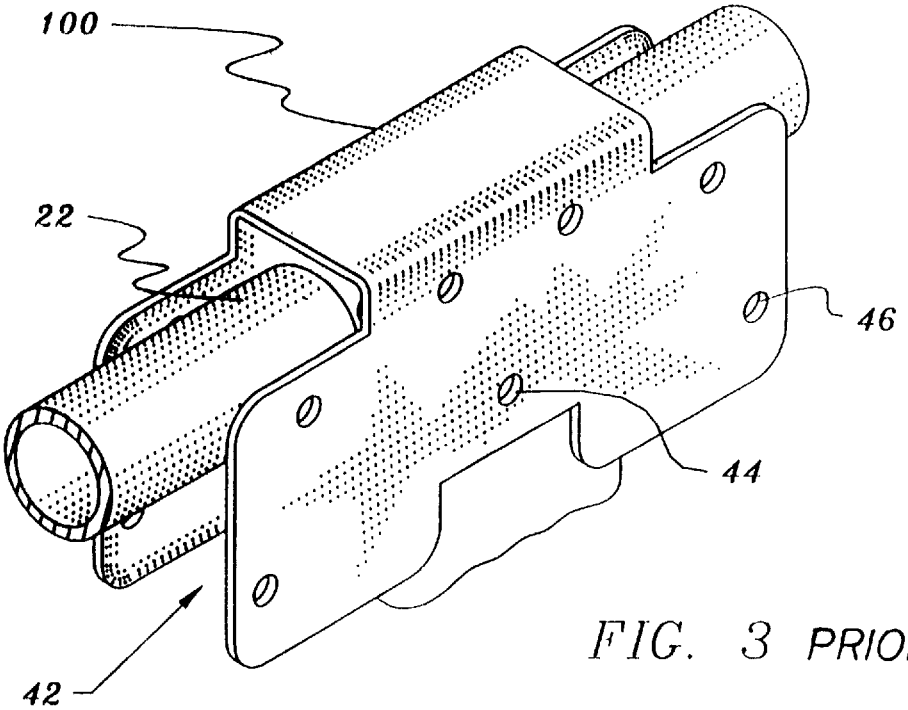
FIG. 3 PRIOR ART
FIG. 3 is an enlarged perspective illustration of the hinge assembly shown in the prior figures.
Figure 4:
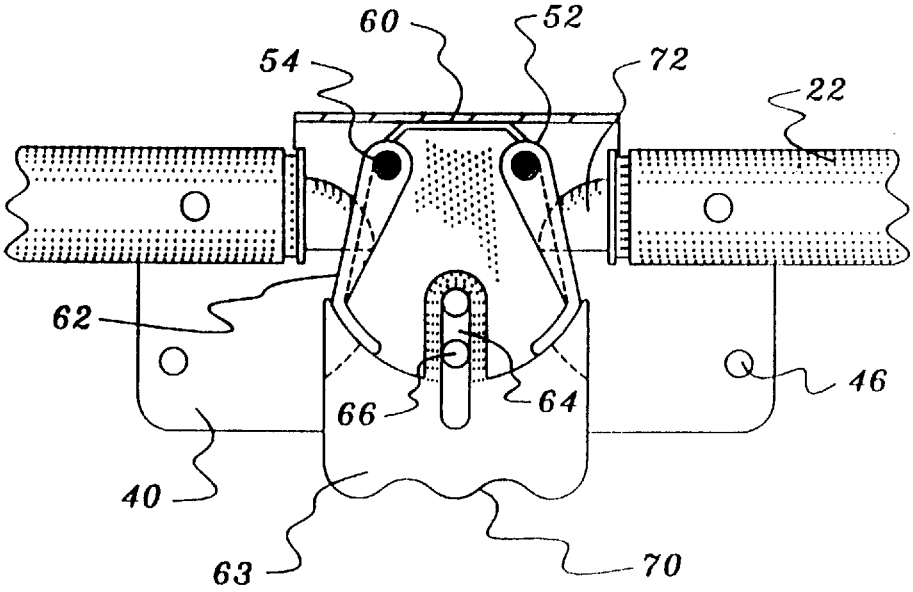
FIG. 4 PRIOR ART
FIG. 4 is a side elevational view, partly in cross section, of the hinge shown in FIG. 3.

More specifically, the present invention is a playyard 10. It is of a type having a supporting frame 12. The frame has an upper rectangular rail assembly 14. Such rail assembly is positionable in a horizontal orientation as shown in FIGS. 1 and 2. Such orientation is for when the playyard is in an operative or deployed orientation. The frame assembly, rectangular in the primary embodiment, is provided with two longer side rails 16 and two shorter ends rails 18. The rails, in an alternate embodiment, are all of equal length to form a square playyard. Each of the rails, whether the side rails or the end rails, is formed to include two rail components 20. Each rail component has an interior end 22 and an exterior end 24.

The interior ends of the rails are pivotally coupled with respect to each other through a hinge assembly to be later described. Such hinge allows movement between the deployed orientation as shown in FIG. 1 wherein the rails are horizontally disposed in a common plane with the rail components being in axial alignment one with respect to another and a collapsed orientation wherein the rails are all essentially disposed vertically and parallel with respect to each other. Note FIG. 5.

The frame also includes a lower rail assembly 26. The lower rail assembly is positionable in a horizontal orientation. Note FIG. 2. Such orientation is at a location be neath the upper rail assembly when it is deployed.

The frame also includes four vertically extending corner rails 30. Such rails are pivotally coupled at their upper ends through fixed upper corner brackets 32 to their upper rail assemblies and at their lower ends through fixed lower corner brackets or feet 34 to the lower rail assemblies. Upper corner brackets and lower corner brackets effect the coupling of the vertical rails to the upper and lower rail assemblies in the conventional manner. Further details of the lower rail assembly may be had by reference to U.S. Pat. No. 5,381,570 to Top Fortune. The subject matter of such patent is incorporated herein by reference.

Also provided as a major component of the playyard 10 are fabric components. Such fabric components include a lower panel 36 positioned above the lower rail assembly. Also included as part of the component assembly are side panels 38. Such side panels are located between the upper and lower rail assemblies and between the vertical corner rails.

The unique feature of the present invention is principally in the hinge. There are preferably four similarly configured hinges, one positioned at the intermediate extents of the end rails and the side rails which are at the adjacent interior ends of the associated rail components. The function of the hinge is to allow safe and convenient movement of the associated rail components between a horizontal orientation and the collapsed orientation. Each hinge includes as its major component a saddle 40. The saddle is a rigid member in a generally inverted U-shaped configuration. Each hinge is provided with a central button aperture 42 as well as interior plate apertures 44 and exterior rail apertures 46. The rail apertures are provided with rail pins 48. The rail pins extend through associated apertures in the adjacent ends of the rail components for pivotally coupling the saddle and the adjacent interior ends of the associated rail components.

Figure 5:
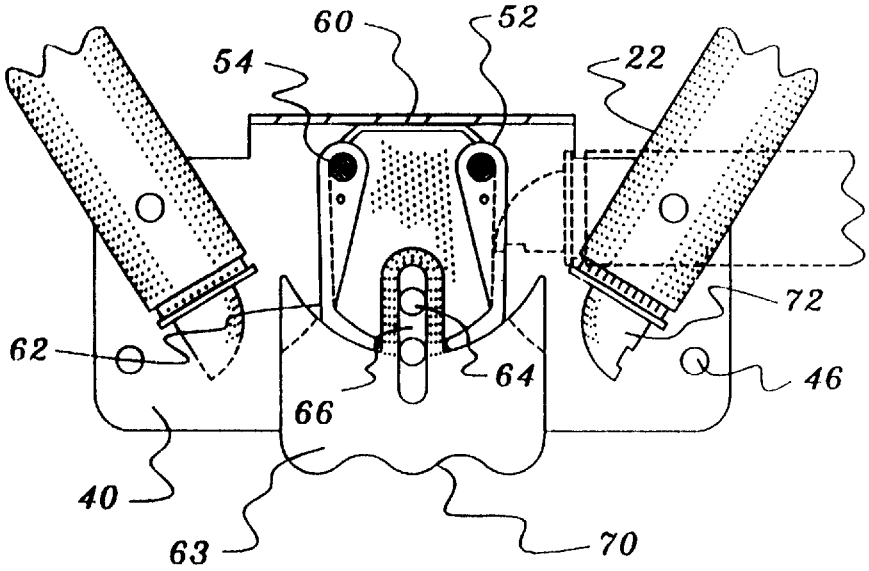
FIG. 5 PRIOR ART
FIG. 5 is a view similar to FIG. 4 but illustrating the hinge in the collapsed orientation.
Figure 6:
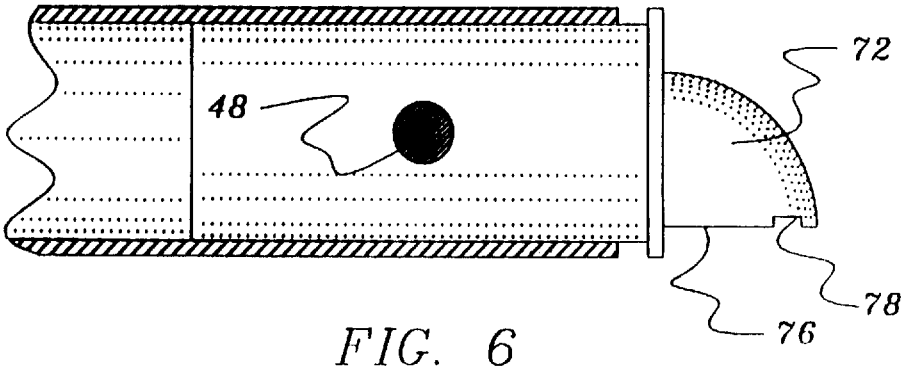
FIG. 6 PRIOR ART
FIG. 6 is a cross-sectional view of one of the interior ends of an end rail shown in FIGS. 4 and 5.
Figure 7:
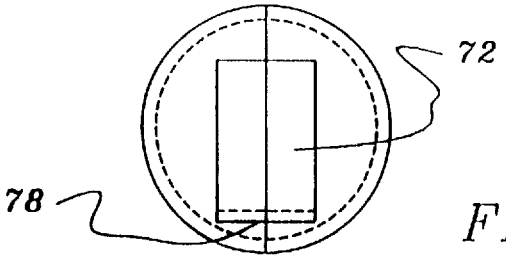
FIG. 7 PRIOR ART
FIG. 7 is an end elevational view of the rail section shown in FIG. 6.
Figure 8:
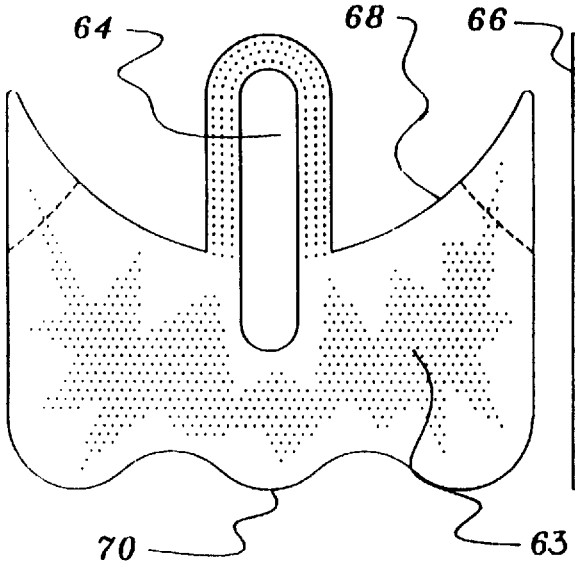
FIG. 8 PRIOR ART
FIGS. 8 and 9 are enlarged side and end elevational views of the button shown in FIGS. 4 and 5.
Figure 9:
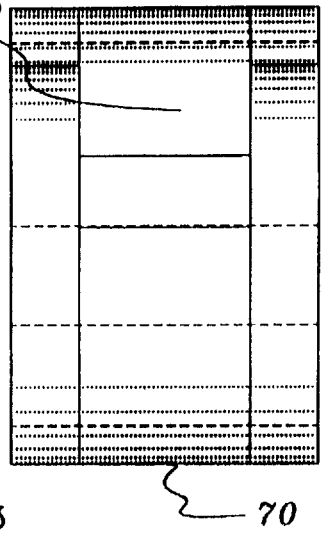
FIG. 9 PRIOR ART
Figure 10:
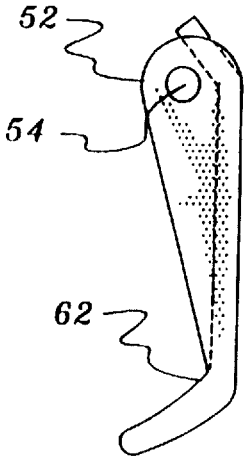
FIGS. 10 and 11 are enlarged end side elevational views of a hinge plate shown in FIGS. 4 and 5.
Figure 11:
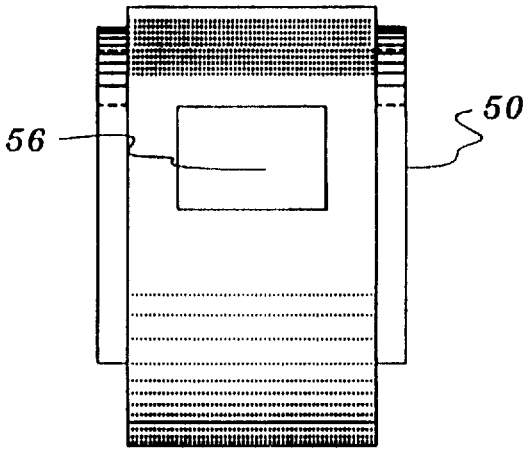
FIG. 11 PRIOR ART
Figure 12:
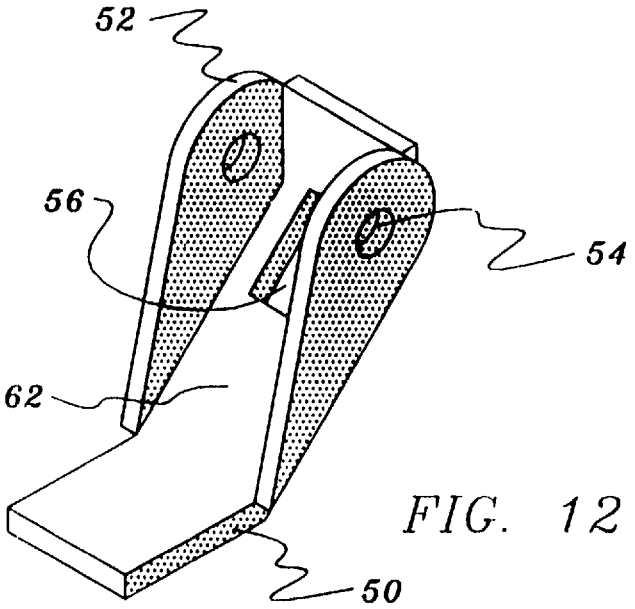
FIG. 12 PRIOR ART
FIG. 12 is a perspective illustration of the hinge plate shown in FIGS. 10 and 11.
Figure 13:
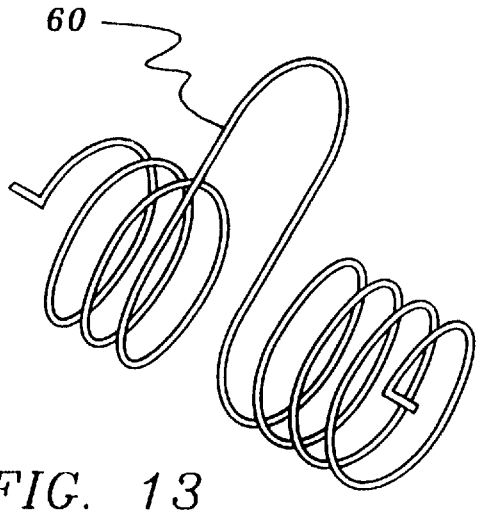
FIG. 13 PRIOR ART
FIG. 13 is a perspective illustration of one of the springs for biassing the hinge plates to the position of FIG. 5.

A pair of normally vertically-oriented locking plates 50 are also coupled to the saddles. Each locking plate includes a curved upper portion with a central aperture 52 and a plate pin 54 coupling the upper end of each plate to a plate aperture of the saddle. Each plate is also formed with an enlarged opening 56. The opening extends therethrough and is adapted to cooperate with the rail components as will be later described. Each opening has a lower bearing surface 58. In addition, springs, preferably coil springs 60, one for each locking plate, are located around the plate pins 54 in contact with the saddle at their upper axially exterior ends and the plates at their lower central extents tending to urge the plates away from each other toward a vertical orientation as shown in FIG. 5 for locking purposes.

Movement of the plates when changing orientation of the rails is effected through a liftable button 63. Each such liftable block, one for each saddle and hinge, has a slot 64 through a central extent thereof. The slot is vertically oriented with a block pin 66 extending therethrough and coupled to the lock apertures of the saddle. This will allow for the sliding coupling of the block with respect to the saddle. The button is also formed to have inclined bearing surfaces 68. Such bearing surfaces are at the upper exterior edges of the block and are adapted, when the block is lifted, to contact the lower ends of the plates and move them toward each other when removing the coupling effect between the rail components achieved by the locking plates. The lower surface 70 of the block is adapted to be contacted by a user and squeezed upwardly against the upper extent of the saddle when orienting the hinge to the collapsed orientation. Such lower surface is formed with undulations for receiving a user's fingers.

Located within the apertures of each rail is an inwardly facing projection 72. Such projections are located at the interior edge 74 of each rod segment. Each projection has an upper surface adapted to contact the lower edge of the locking plates and push them inwardly when moving toward the deployed orientation. Each projection has a lower planar surface 76. The lower planar surface is provided with a notch 78. Such notches are adapted to receive the bearing surfaces of the plate when the rod segments are in axial alignment at the deployed orientation. Such an arrangement of the notch coupled with respect to the bearing surface functions to maintain the playyard deployed. Further, upward movement of the button will have its inclined bearing surfaces contact the lower edges of the plates to move the plates inwardly. When coupled by an overall movement of the hinge upwardly, to move the notches from the bearing surface, will allow the collapsing of the rails to the collapsed orientation of the playyard.

It has been found that when the playyard is in the open deployed orientation for use, the entire frame, including the regions of the central hinges on the upper frame assembly, are in a high force condition of tension/compression due to the orientation of the rails, hinge plates, hinges, corner brackets and the like. Lifting of the buttons to collapse the frame is virtually impossible by forces which might be extended by a child within the playyard or a care provider outside of the playyard. When, however, the hinges of the lower frame assembly are lifted to bend the central extent of the rails of the lower frame assembly, then the forces acting on the central hinges of the upper rail assembly are relieved and the buttons can then be lifted to allow the collapsing of the upper rail assembly and the playyard. The projections extending through the apertures of the hinge plates provide the locking forces to maintain the playyard safely deployed. In addition, the notches in the projections and the associated bearing surfaces in the hinge plates constitute a supplemental and redundant safety feature to further preclude inadvertent collapsing of the playyard.

As can be seen from the foregoing, a simple lifting of the hinge by lifting the saddle upwardly from the collapsed orientation will automatically allow the projections to enter the openings of the plates and for the notches of the projections to receive the bearing surfaces in the openings of the plates. Conversely, the squeezing of the central extent of the hinge will cause the block to move upwardly and have its inclined bearing surfaces move the lower ends of the plates inwardly against the action of the spring. When coupled with a slight vertical upward and downward movement, the saddle will separate the notches from the bearing surfaces of the plates to allow the movement of the hinge downwardly and the playyard to the collapsed orientation.

Figure 14:
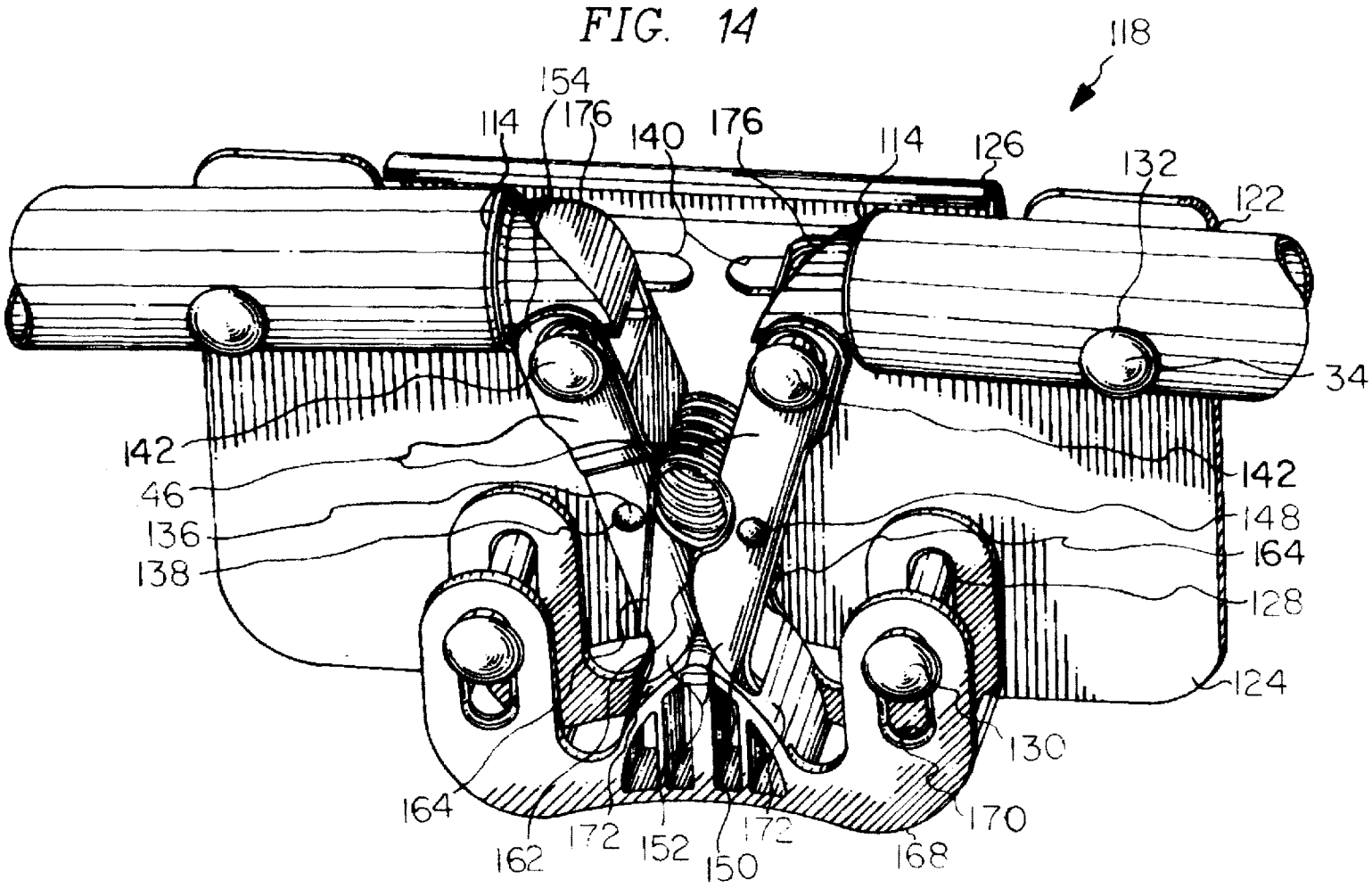
FIG. 14 is a hinge in a deployed orientation constructed in accordance with an alternate embodiment of the invention.
Figure 15:
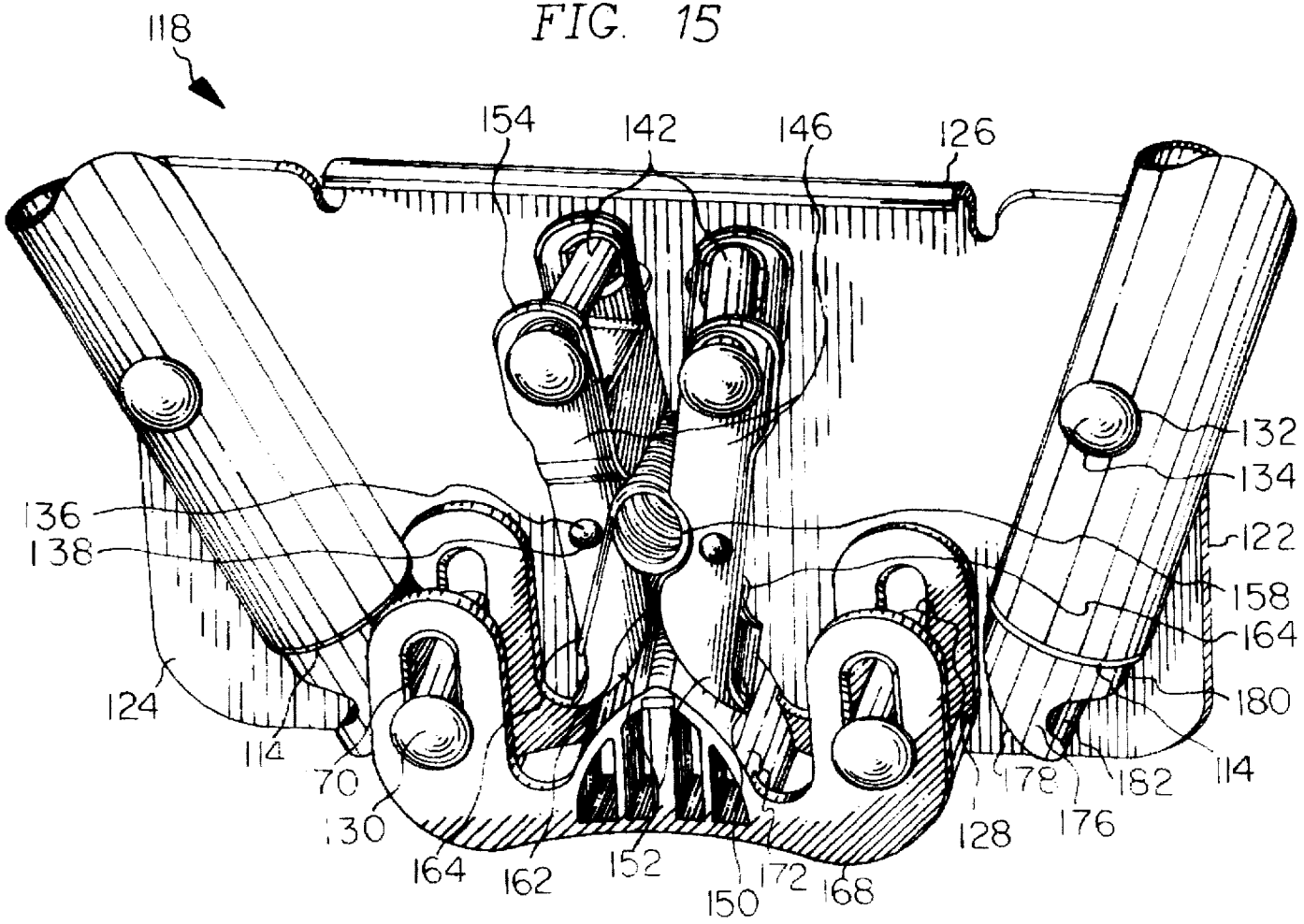
FIG. 15 is the hinge of FIG. 14 but in a partially collapsed orientation.

An alternate embodiment of the invention is shown in FIGS. 14 and 15. As in the primary embodiment, essentially all of the elements of the playyard, except for the hinge, are fully illustrated. In this regard, the preferred playyard for the hinge of the alternate embodiment is shown in co-pending application Ser. No. P-4153, filed concurrently herewith, the subject matter of which is incorporated herein by reference. The present invention is an improvement over pending application Ser. No. 08/734,151 filed Oct. 21, 1996, the subject matter of which is incorporated herein by reference.

In the alternate embodiment, the central component is an improved hinge 118. Such hinge is positioned at the intermediate extents of the end rails and side rails, at their interior ends 114, to allow movement of the associated rail components between a horizontal deployed orientation and the collapsed orientation. Each of the four hinges includes as its central component a saddle 122. The saddle is formed in a generally inverted U-shaped configuration. It includes opposed parallel faces 124 with a coupling curved region 126 thereabove. The opposed faces each have a pair of laterally spaced block apertures 128 with block pins 130 extending in the block apertures between opposed faces of the saddle. Also provided is a pair of laterally spaced rail apertures 132. Rail pins 134 are located between such apertures. In addition, a pair of laterally spaced locking lever apertures 136 are also provided in the faces with lever pins 138 extending therethrough. Lastly, a pair of laterally spaced generally-horizontal guide slots 140 are also formed in the faces of the saddle with guide pins 142 therethrough.

Next provided are a pair of locking levers 146 in a generally vertically-oriented position. Each locking lever has a central aperture 148 for receiving a lever pin. Each locking lever is formed to have a lower end 150 with a facing curved following face 152 and an upper end 154 with apertures receiving the lever pins. Arcuate facing interior surfaces 158 are formed at the interior regions of the upper edge of the locking levers.

A coil spring 162 is next provided. The coil spring has a central horizontal axis. It also has an exterior surface received within the facing recesses of the levers at their central extents. The coil spring also has ends 164 which extend downwardly into contact with the exterior faces of the levers. The ends and central extent of the coil spring tend to move the lower ends of the levers inwardly and the upper ends of the levers outwardly.

The last component of the hinge is a liftable block 168. Such block is formed to have generally vertically extending slots 170 adjacent the lateral edges thereof. Such slots are for receiving the block pins. This relationship allows the raising and lowering of the block between a lower locking deployed orientation and an upward unlocking collapsed orientation. The block also has a central region with cam surfaces 172. Such cam surfaces are adapted to contact the curved surfaces at the lower ends of the levers. In this manner, movement of the block and the cam surfaces upwardly will urge the lower ends of the levers outwardly and the upper ends of the levers inwardly.

In association with the hinge are facing projections 176. Such facing projections are located at the adjacent interior ends of each adjacent rod segment. Each projection has an upper curved surface 178 and a lower planar surface 180. The lower planar surface is formed with an arcuate recess 182 adapted to receive a guide pin when in the deployed locked orientation. The upper curved surfaces of the projections are adapted to move the guide pins inwardly toward each other when moving the hinge from the stowed orientation to the locked orientation. During such movement, the guide pin movement is guided by the guide slots. As such, the positioning of the block in the lower orientation will allow the lower ends of the levers to be in proximity to each other and urged into such orientation by the coil spring. Conversely, upward movement of the hinge from the stowed orientation to the deployed orientation will move the guide pins and upper ends of the levers outwardly through the force of the upper curved surfaces of the projections. This allows the positioning of the guide pins in the lower recesses of the projections. During collapsing, upward movement of the block will urge the lower ends of the levers outwardly and the inward ends of the levers inwardly. This will thereby separate the guide pins from the recesses of the projections to thereby allow the projections and interior ends of the rails to move downwardly to collapse the hinge and frame of the playyard.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A collapsible playyard comprising, in combination:

a frame with an upper rail assembly positionable in a horizontal orientation when in a deployed orientation and formed of two side rails and two end rails with each of the rails being formed of two rail components having interior ends and exterior ends, the interior ends being pivotally coupled with respect to each other for movement between the deployed orientation wherein the rails are horizontally disposed in a common plane and a collapsed orientation wherein the rails are vertically disposed and parallel, the frame also including a lower rail assembly positionable in a horizontal orientation beneath the upper rail assembly when in a deployed orientation, the frame also including four vertically extending corner rails coupling the upper rail assembly and the lower rail assembly, the playyard also having fabric components between the upper and lower rail assemblies and between the corner rails;

a hinge positioned at the intermediate extents of the end rails and side rails to allow movement of the associated rail components between the horizontal deployed orientation and the collapsed orientation, each hinge including;

a saddle in a generally inverted U-shaped configuration with opposed parallel faces and a coupling region thereabove, the opposed faces each having a pair of laterally spaced block apertures with block pins therebetween, a pair of laterally spaced rail apertures with rail pins therebetween, a pair of laterally spaced locking lever apertures with lever pins therethrough and a pair of laterally spaced generally horizontal guide slots with guide pins therethrough;

a pair of normally vertically-oriented locking levers, each locking lever having a central aperture for receiving a lever pin, each locking lever having a lower end with a facing curved follower face and an upper end with an aperture receiving a guide pin and with an arcuate facing interior surface at the interior region thereof;

a coil spring having a central horizontal axis with an exterior surface received within the facing recesses of the levers and with ends extending downwardly into contact with the exterior faces of the levers tending to move the lower ends of the levers inwardly and the upper ends of the levers outwardly;

a liftable block with generally vertically extending slots adjacent lateral edges thereof receiving the block pins and adapted to allow the raising and lowering of the block between a lower locking deployed orientation and an upward unlocking collapsed orientation, the block also having a central region with cam surfaces adapted to contact the curved surfaces at the lower ends of the levers whereby movement of the block and the cam surfaces upwardly will urge the lower ends of the levers outwardly and the upper ends of the levers inwardly; and facing projections located at the adjacent interior ends of each adjacent rail component, each projection having an upper curved surface and a lower planar surface with an arcuate recess adapted to receive a guide pin when in the deployed locked orientation with the upper curved surfaces of the projections adapted to move the guide pins inwardly toward each other when moving the hinge from the stowed orientation to the locked orientation with the guide pin movement being guided by the guide slots whereby the positioning of the block in its lower orientation will allow the lower ends of the levers to be in proximity to each other and urged in such orientation by the coil spring but whereby upward movement of the hinge from the stowed orientation to the deployed orientation will move the guide pins and upper ends of the levers outwardly through the force of the upper curved surfaces of the projections to allow the positioning of the guide pins in the lower recesses of the projections and whereby, during collapsing, upward movement of the block will urge the lower ends of the levers outwardly and the upper ends of the levers inwardly to thereby separate the guide pins from the recesses of the projections and allow the projections and interior ends of the rails to move downwardly to collapse the hinge and frame of the playyard.

2. A hinge for a collapsible playyard comprising:

a saddle in a generally inverted U-shaped configuration with opposed parallel faces and a coupling region thereabove, the opposed faces each having a pair of laterally spaced block apertures with block pins therebetween, a pair of laterally spaced rail apertures with rail pins therebetween, a pair of laterally spaced locking lever apertures with lever pins therethrough and a pair of laterally spaced generally horizontal guide slots with guide pins therethrough;

a pair of normally vertically-oriented locking levers, each locking lever having a central aperture for receiving a lever pin, each locking lever having a lower end with a facing curved follower face and an upper end with an aperture receiving a guide pin and with an arcuate facing interior surface at the interior region thereof;

a spring tending to move the lower ends of the levers inwardly and the upper ends of the levers outwardly; and a liftable block with generally vertically extending slots adjacent lateral edges thereof receiving the block pins and adapted to allow the raising and lowering of the block between a lower locking deployed orientation and an upward unlocking collapsed orientation, the block also having a central region with cam surfaces adapted to contact the curved surfaces at the lower ends of the levers whereby movement of the block and the cam surfaces upwardly will urge the lower ends of the levers outwardly and the upper ends of the levers inwardly.

3. The hinge as set forth in claim 2 wherein the spring is a coil spring having a central horizontal axis with an exterior surface received within the facing recesses of the levers and with ends extending downwardly into contact with the exterior faces of the levers tending to move the lower ends of the levers inwardly and the upper ends of the levers outwardly.

* * * * *